US007707864B1

(12) United States Patent
Melendez et al.

(10) Patent No.: US 7,707,864 B1
(45) Date of Patent: May 4, 2010

(54) LOCKING DEVICE

(76) Inventors: Justin Melendez, 67-31 Kissena Blvd., Apt. 5C, Flushing, NY (US) 11367; Mitchell Shuster, 615 B Waupelani Dr., State College, PA (US) 16801

( * ) Notice: Subject to any disclaimer, the term of this patent is extended or adjusted under 35 U.S.C. 154(b) by 409 days.

(21) Appl. No.: 11/205,748

(22) Filed: Aug. 17, 2005

Related U.S. Application Data

(60) Provisional application No. 60/602,164, filed on Aug. 17, 2004.

(51) Int. Cl.
*E05B 27/04* (2006.01)

(52) U.S. Cl. ..... 70/493; 70/358; 70/419; 70/DIG. 22; 70/DIG. 25

(58) Field of Classification Search ..... 70/378, 70/392, 492–495, 358, 359, 419, DIG. 1, 70/DIG. 2, DIG. 21, DIG. 22, DIG. 25
See application file for complete search history.

(56) References Cited

U.S. PATENT DOCUMENTS

| | | | | |
|---|---|---|---|---|
| 1,340,804 | A * | 5/1920 | Thompson | 70/493 |
| 2,111,098 | A | 3/1938 | Segal | |
| 2,197,952 | A * | 4/1940 | Stone | 70/493 |
| 2,283,489 | A | 5/1942 | Crousore | |
| 2,629,249 | A * | 2/1953 | Mendelsohn | 70/419 |
| 3,762,193 | A * | 10/1973 | Hucknall | 70/419 |
| 4,222,252 | A * | 9/1980 | Tietz | 70/495 |
| 4,377,940 | A * | 3/1983 | Hucknall | 70/495 |
| 4,393,673 | A * | 7/1983 | Widen | 70/358 |
| 4,577,479 | A | 3/1986 | Widén | |
| 4,723,427 | A | 2/1988 | Oliver | |
| 5,289,709 | A | 3/1994 | Field | |
| 5,533,369 | A * | 7/1996 | Valdajos-Gallego | 70/493 |
| 5,775,144 | A * | 7/1998 | Pagalday | 70/358 |
| 6,125,674 | A * | 10/2000 | Aramburu | 70/358 |
| 6,508,091 | B1 * | 1/2003 | Donatini | 70/359 |
| 6,532,781 | B1 * | 3/2003 | Keller | 70/358 |
| 6,912,881 | B2 * | 7/2005 | Kleinhaeni | 70/409 |

* cited by examiner

*Primary Examiner*—Lloyd A Gall

(57) ABSTRACT

A lock includes a housing with a plug located in the housing. The plug is adapted to rotate in the housing about an axis. The lock also includes a moveable element comprising a first region with a first diameter, a second region with a second diameter that is less than the first diameter, and a third region with a third diameter that is less than the second diameter. The moveable element is located at least partly in the housing. The moveable element is adapted to move in an axis of motion substantially radial relative to the axis of the plug and to prevent rotation of the plug when the moveable element is in a first position along the axis of motion and to allow rotation of the plug when the moveable element is in a second position along the axis of motion.

7 Claims, 19 Drawing Sheets

LOCKING DEVICE

RELATED APPLICATIONS

This application claims priority under 35 U.S.C. §119(e) to U.S. Provisional Application Ser. No. 60/602,164, entitled "HIGH SECURITY LOCKING APPARATUS AND METHODS," filed on Aug. 17, 2004, which is herein incorporated by reference in its entirety.

BACKGROUND OF INVENTION

1. Field of Invention

The invention relates generally to locking devices, and in particular, to the design and manufacture of locks.

2. Discussion of Related Art

A key-based lock is a mechanical fastening device which may be used on a door, vehicle, or container, for example, in order to prevent access to anyone without a correct key. Most modern locks employ a conventional "pin and tumbler" system to recognize when a correct key has been inserted into a lock. A conventional lock typically includes a plug (e.g., a cylinder) 20, a housing 22 (into which the plug fits) and a plurality of movable elements. Pairs of key pins and movable elements 28 (e.g., drive pins) are associated with one another. The pairs are disposed vertically with the key pin 26 below the moveable element 28 which engages the top of the key pin 26 in a shaft 30 which is present in the plug 20 and the housing 22. Springs in each shaft bias the associated moveable element 28 in the direction of the key pin 26. The moveable elements 28 push on the associated key pin 26 to maintain the position of the key pin 26 and the moveable element 28. Both the key pin 26 and the moveable element 28 may vary in length, however, in most conventional locks, the moveable elements 28 are typically all of the same length.

When no key is inserted in the conventional pin and tumbler lock, the key pin 26 is completely inside the plug 20, while the moveable element 28 is partially in the plug 20 and partially in the housing 22. The position of the moveable elements 28 keeps the plug 20 from turning (e.g., rotating). Thus, when no key (or the incorrect key) is inserted in the lock, the moveable elements 28 substantially fix the position of the plug 20 within the housing 22.

When a key is inserted in a conventional lock, the series of notches in the key push the pairs of key pins 26 and moveable elements 28 upward by varying amounts. An incorrect key moves at least one pair of key pins 26 and moveable elements 28 an incorrect amount such that either: 1) the pair is not moved far enough (i.e., the moveable element 28 continues to extend into both the housing 22 and the plug 20); or 2) the pair is moved too far upward (i.e., the key pin 26 extends into both the housing 22 and the plug 20).

A correct key moves each pair of key pins 26 and moveable elements 28 upward just enough so that an abutment surface occurring where the key pin 26 contacts the moveable element 28 aligns with the space where the plug 20 and the housing 22 meet (this boundary between the plug 20 and the housing 22 may be referred to as a shear line 38). Accordingly, a correct key moves the pairs of key pins 26 and moveable elements 28 into a position where all of the moveable elements 28 are inserted completely in the housing 22, while all of the key pins 26 rest completely in the plug 20. Thus, with no key pins 26 or moveable elements 28 interfering with a rotation of the plug 20 in the housing 22, the plug 20 rotates freely about an axis of rotation, and the bolt or locking device is able to move. Conventional locks are typically employed in a locking system where the plug 20 is mechanically connected to a cam, which in turn operates a spring to engage and disengage a latch.

Although locks are used for security purposes, the conventional lock may be opened without a key (e.g., the lock may be picked) thereby reducing or eliminating the effectiveness of the lock. Lock picking takes advantage of manufacturing tolerances and manufacturing defects present in virtually all conventional locks. These tolerances and defects allow the plug 20 to be rotated slightly in the housing 22 even when the lock is locked. Consequently, each moveable element 28 may rest on the shear line 38 when the abutment surface of a pair of key pins 26 and moveable elements 28 is aligned with the shear line 38 and the rotation of the plug 20 in the locked position is forced by an amount allowed by the manufacturing tolerance and/or defect. Lock pickers typically employ a tension wrench (i.e., a tensor) and a pick to pick a lock. In practice, the tension wrench is inserted into the keyhole and twisted slightly. The twisting of the wrench acts to rotate the plug 20 slightly, owing to the small spaces left in the shafts between the edges of the moveable elements 28 and the plug 20 (these are the manufacturing tolerances/defects referred to above). The rotation creates a ledge along the shear line 38 on which the moveable elements 28 can rest. The moveable element 28 rests on a ledge created by the portion of the outer surface of the plug 20 located at the radially inward end of the portion of the shaft 30 within the housing 22. The lock picker has in effect offset the portion of the shaft 30 in the housing 22 and the portion of the shaft 30 in the plug 20, i.e., the shaft in the housing 22 is no longer coaxially located with the shaft in the plug 20.

The pick is applied to each pair of key pins 26 and moveable elements 28 so that each moveable element 28 resides entirely within the housing 22 while resting on the ledges provided by the plug 20 at the shear line 38. The key pins 26 are then allowed to drop while a rotational force remains applied to the plug 20. If the proper amount of torque is applied, the key pins 26 fall back into the plug 20, while the Moveable elements 28 are caught on the ledge created by the slightly rotated plug 20. If this is accomplished, there are no longer any pins binding the plug 20 to the cylinder housing 22 and the plug can freely rotate as though the correct key had been used, i.e., the lock is unlocked.

Some known locks have been created with additional security features in an attempt to improve the security offered by the conventional lock designs. One such lock design is described in U.S. Pat. Nos. 5,289,709 and 6,718,807. The lock design described therein includes a side bar and rotating pins.

An example is illustrated in FIG. 1. Here, the key pins have a valley 54 cut into the side, and the bottom edges 56 of the key pins (the part that contacts the key) are not horizontal (as in most locks), but are instead beveled to a range of angles. The proper key also has beveled teeth designed to match the beveled edge of the key pin in such a way as to rotate the pins to the proper orientation. This rotation aligns the valleys in the side of the key pins with extensions 58 extending from the side bar 44. When the extensions do not lie in the valleys, the side bar is pushed out slightly, so that it lies between the plug and the cylinder housing. This prevents the plug from rotating, just as the pins do. When the pins are all rotated correctly, the protrusions from the side bar all lie in the valleys in the key pins, and the side bar moves out of the way, allowing the plug to rotate and the lock to open (assuming, of course, that the pins have been raised to the appropriate heights).

Although such designs may improve the security of the lock in view of some traditional lock-picking approaches, these designs may be successfully picked by employing other methods of lock picking. One such method, which has been reported, is the employment of a diamond rake bent at a 15 degree angle, which rakes both the pin heights and the pin rotations at the same time. Another reported method is the use of a bumping device which consists of a key with all its teeth cut to the maximum depth, whose beveling matches that of the correct key. The 'bump key' is then hit with some force to bump the key pins in the same manner as a lock gun, while holding the key pins at the correct rotational alignment. Thus, while these designs may increase the security of a lock, they may still be picked by an individual skilled in the craft of lock picking.

Another known variation in some conventional locks includes "mushroom" moveable elements, which, in one version, have a bottom that is shaped like an upside-down mushroom (other shapes are also possible for the "mushroom" moveable element, as shown at the top of FIG. 2). All these configurations are sometimes referred to, generally as "mushroom drivers." In conventional locks with "mushroom" moveable elements, as shown in FIG. 2, the mushroom-shaped portion 28A of the moveable element 28 may get caught between the housing 22 and the plug 20 if too much torque is applied when picking. While these pins may make the picking process more difficult, they present only a marginal increase in difficulty, especially if one employs mechanical or electrical devices such as pick guns.

SUMMARY OF INVENTION

In one aspect, a lock includes a housing with a plug located in the housing. The plug is adapted to rotate in the housing about an axis. The lock also includes a moveable element comprising a first region with a first diameter, a second region with a second diameter that is less than the first diameter, and a third region with a third diameter that is less than the second diameter. The moveable element is located at least partly in the housing. The moveable element is adapted to move in an axis of motion substantially radial relative to the axis of the plug and to prevent rotation of the plug when the moveable element is in a first position along the axis of motion and to allow rotation of the plug when the moveable element is in a second position along the axis of motion. The second region is located closer to the axis of the plug than the first region, and at least a part of the third region is located closer to the axis of the plug than the second region.

In one embodiment, an insert provides a shaft located in the plug and the moveable element is adapted to move in the insert. According to a further embodiment, a second region is located closer to the axis of the plug than a first region, and a protrusion, with a third diameter that is greater than the second diameter and less than the first diameter, protrudes from the second region. In a version of this embodiment, a difference between one half of the first diameter and one half of the third diameter is greater than twice a difference between one half the diameter of the shaft and one half of the first diameter.

In another aspect, a lock includes a housing, a plug adapted to rotate in the housing about an axis, and a moveable element that travels in a first shaft located in the housing and in a second shaft located in the plug, the moveable element including a protrusion, where a method of manufacture includes acts of inserting into the second shaft an insert including at least one recess adapted to receive the protrusion, locating the moveable element in one of the first shaft or the second shaft, and locating the plug in the housing.

BRIEF DESCRIPTION OF DRAWINGS

The accompanying drawings are not intended to be drawn to scale. For purposes of clarity, not every component may be labeled in every drawing. In the drawings.

DETAILED DESCRIPTION

Figure 1A:
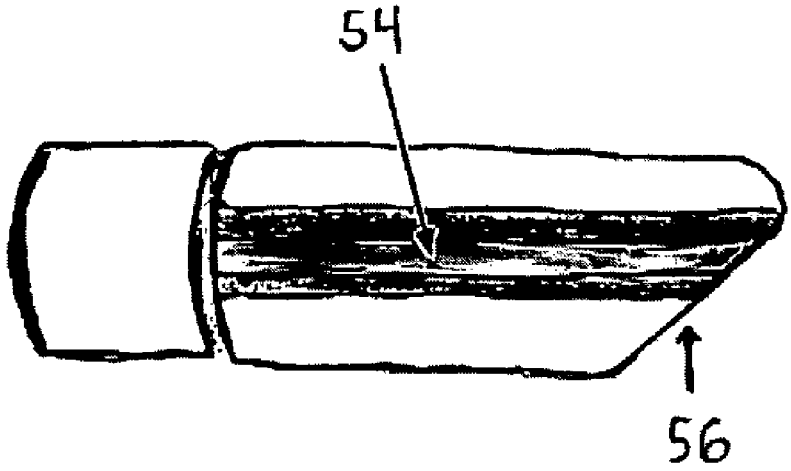
FIG. 1A Prior Art
FIGS. 1A-1B are views of another prior art lock.
Figure 1B:
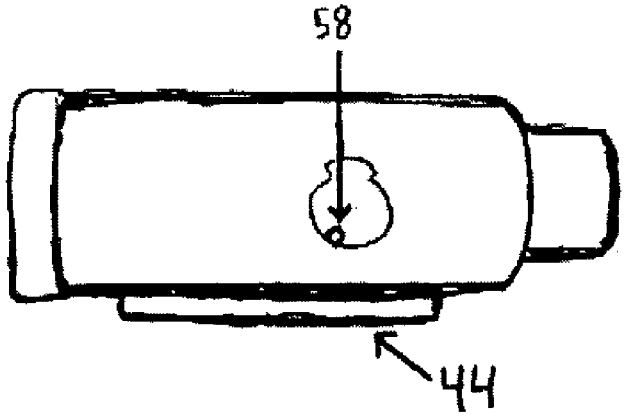
FIG. 1B Prior Art
Figure 2:
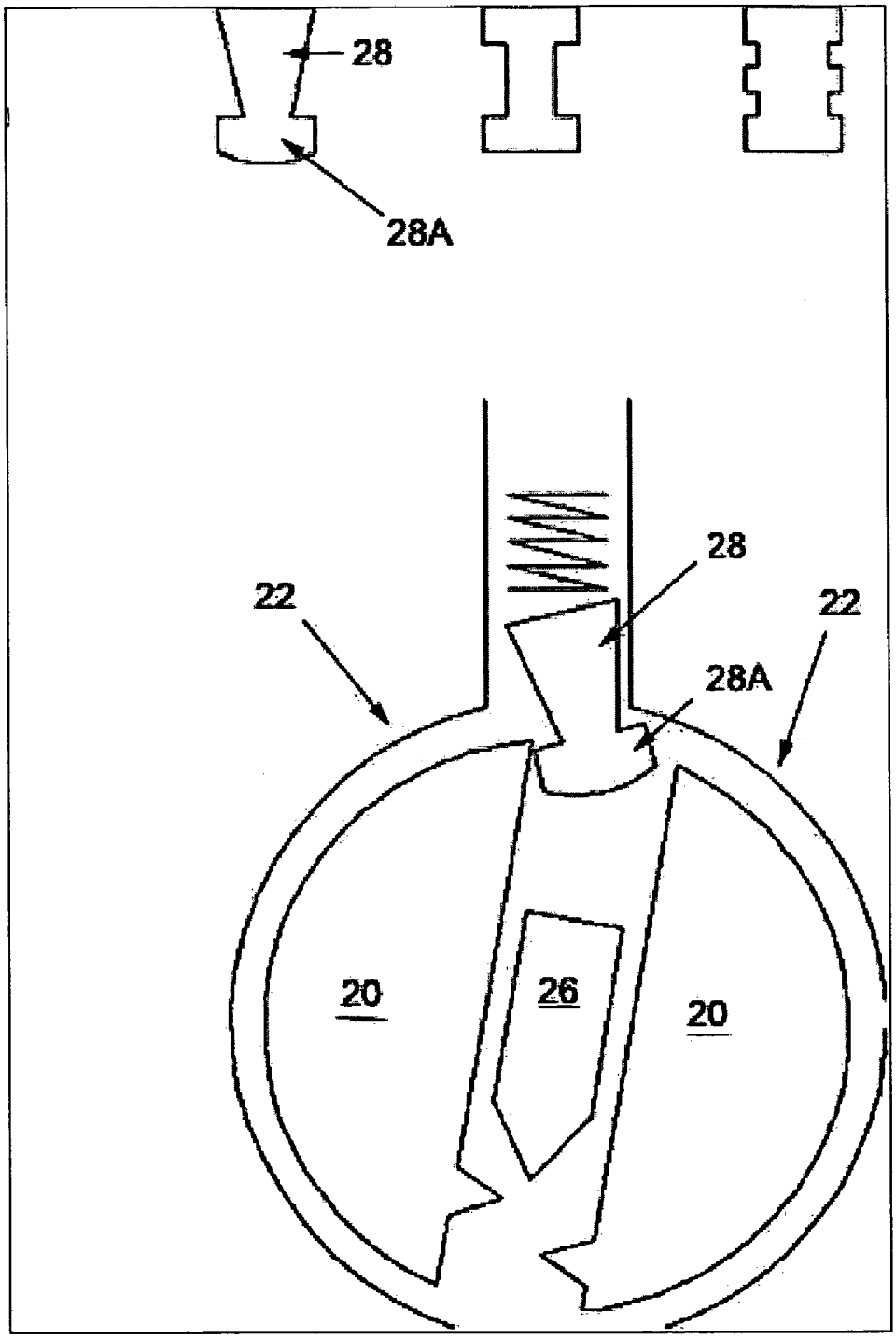
FIG. 2 Prior Art
FIG. 2 is a view of yet another prior art lock.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

In view of the foregoing, various embodiments of the present disclosure are directed to a lock designed to substantially impede known lock-picking techniques.

According to various embodiments of the present invention, a locking apparatus employs one or more moveable elements (e.g., driver pins) designed to improve the security of the locking apparatus. In one or more versions of these embodiments, the modified moveable elements are employed in a lock that uses a pin and tumbler design. In some embodiments, one or more modified shaft(s) also are employed, in a complimentary arrangement with the modified moveable element(s), to prevent the lock from being opened without the correct key, i.e., rendering the lock substantially "pick-proof."

Methods of manufacturing a lock in accordance with one or more embodiments of the invention are also described.

In one embodiment, the moveable elements are modified so as to create a multi-tiered moveable element having at least one ledge between different regions of the moveable element. In a version of this embodiment, a two-tiered moveable element including two portions with respectively different diameters may be formed so as to create a ledge on the pin. A variety of structures, however, may be employed alone or in combination to provide a moveable element with one or more ledges. As is described in greater detail below, these ledges can be included to increase the security of a lock employing the moveable element, i.e., they make the lock more difficult to pick.

Figure 3:
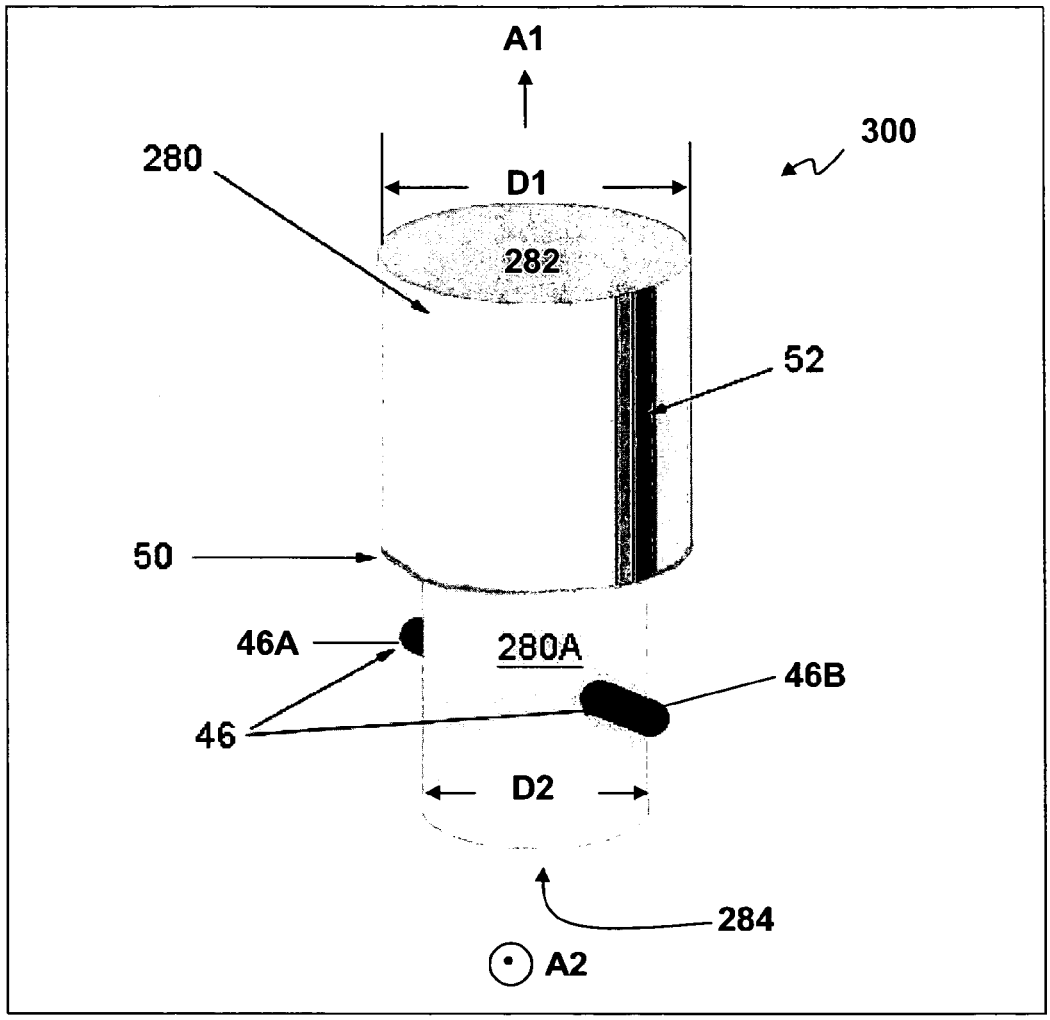
FIG. 3 is a view of a moveable element in accordance with one embodiment of the invention.

Referring to FIG. 3, a moveable element 300 in accordance with an embodiment of the invention is shown. The moveable element 300 includes a first region 280, and a second region 280A. The first region 280 has a first diameter D1 and the second region 280A has a second diameter D2. The moveable element 300 also includes protrusions 46, a ledge 50, and an alignment element 52.

According to one embodiment, the moveable element travels in an axis of motion A1. For example, if the moveable element 300 of FIG. 3 is employed in a lock using a pin and tumbler design, the axis of motion A1 is linear. Further, where a lock having a plug is employed as described, the axis of motion A1 of the moveable element may be radial or substantially radial relative to an axis of rotation A2 of the plug 20. In one embodiment, the axis of motion A1 is located coaxially with a central longitudinal axis of the moveable element 300.

The ledge 50 is formed where the first region 280 meets the second region 280A because the two regions do not have the same diameter. The first region 280 may also be referred to as the head of the moveable element 300. As shown in FIG. 3, the first region 280 is located a greater distance from the axis of rotation A2 than is the second region 280A. Thus, in one embodiment, a surface 282 formed at the radially outward end of the moveable element 300 (relative to the axis of rotation) engages a spring that applies a radially inward force on the moveable element 300. Further, an abutment surface 284 is located at the opposite end of the moveable element 300. That is, the abutment surface 284 is located at the radially inward end of the moveable element 300 relative to the axis of motion A2. In one embodiment, the abutment surface 284 engages a surface of a key pin that is associated with the moveable element 300.

The moveable element 300 may include any number of regions (e.g., 280, 280A) of varying diameters. In one embodiment, the diameter (e.g., D1, D2) of each successive region (e.g., 280, 280A) decreases as the moveable element 300 is traversed from the radially outward end (e.g., surface 282) to the radially inward end (e.g., surface 284). That is, any region located radially inward of the first region 280 has a smaller diameter than the diameter D1 of first region 280, and any region located inward of the second region 280A has a smaller diameter than the diameter D2 of the second region 280A. As a result, multiple ledges (e.g., ledge 50) can be formed by the moveable element 300.

In one embodiment, the protrusion 46 extends substantially radially outward from the second region 280A relative to the axis of motion A1. In a version of this embodiment, the protrusion is a bar that extends through the moveable element 300. In another version, the protrusion 46 includes two separate elements 46A and 46B. In yet another version, the protrusion 46 includes only one of the elements 46A and 46B. In one embodiment, the diameter of the protrusion 46 is less than at least one region (e.g., first region 280) located radially outward of the protrusion relative to the axis of rotation A2. In a version of this embodiment, the diameter of the protrusion 46 is greater than any region that is located at least partly radially inward of the protrusion (e.g., second region 280A). A protrusion 46 may provide another region on the moveable element 300. Thus, in one embodiment of the moveable element 300 of FIG. 3, the location of the protrusion 46 is a third region having a third diameter measured from the radially outward end of the element 46A (relative to the axis of motion A1) to the radially outward end of the element 46B.

In one embodiment, the protrusion extends 360° annularly about the axis of motion. For example, in one embodiment, the protrusion projects in disc like fashion 360° around the moveable element 300. In other embodiments, the protrusion 46 protrudes from the moveable element 300 continuously about the axis of motion A1 for less than 360° annularly. That is, according to one embodiment, there is a single element (e.g., element 46A or element 46B) that extends in disc like fashion part of the way around the moveable element 300. In yet another embodiment, the protrusion 46 protrudes from the moveable element 300 at discontinuous locations about the axis of motion, creating one or more elements that extend in fan like fashion part or all of the way around the moveable element 300.

Figure 13:
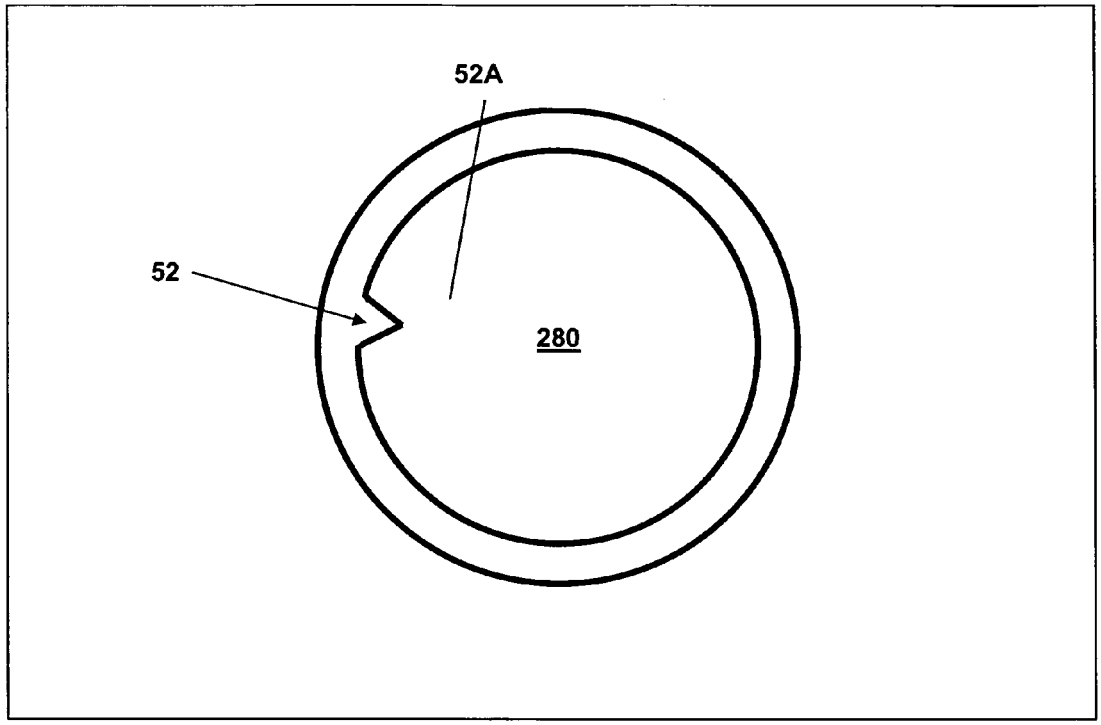
FIG. 13 is a sectional view of a moveable element according to a still further embodiment of the invention.

The alignment element 52 may take the form of a projection, a channel, a groove, a recess or any other structure that prevents or limit the movement (e.g., rotation about the A1 axis) of the moveable element 300 within, for example, a shaft within which the moveable element 300 travels. That is, the alignment element 52 acts to maintain the proper orientation of the moveable element 300 within a lock. The alignment element 52 may by itself limit the movement of the moveable element 300. In addition, in one embodiment, the alignment element 52 is combined with one or more additional elements to maintain the proper orientation of the moveable element 300 within a lock. (One such embodiment is illustrated from a top-down perspective in FIG. 13.) For example, the element 52 may be a projection that is retained within a channel located in the wall of a shaft within which the moveable element 300 travels. In one or more embodiments, alignment elements (e.g., elements 52, 52A) are included in each of the moveable element 300 and the plug 20. As shown in FIG. 13, the plug 20 includes a first alignment element 52 (e.g., a longitudinal projection), and the moveable element 300 includes a second alignment element 52A (e.g., a longitudinal groove).

Although having a generally cylindrical shape as shown in FIG. 3, the moveable element 300 may be any shape that allows the moveable element 300 to prevent a lock from being opened when the moveable element 300 is at a first position on the axis of motion A1 while allowing the lock to be opened when the moveable element 300 is at a second position on the axis of motion A1. For example, a cross section of the various regions (e.g., 280, 280A) of the moveable element 300 may be any geometric shape including circular, elliptical, or any polygon. Further, the various regions (e.g., 280, 280A) need not have the same shape, for example, region 280 may have a circular cross section while region 280A may have a cross section that is triangular in shape.

The terms diameter and radius are not intended to imply that the dimension being referred to is a dimension of an object of any particular shape (e.g., cylindrical, circular). In other words, diameters can be measured for a moveable element 300 having a cross section of any shape including irregular, polygonal or circular. Thus, when referring to the dimensions at a protrusion (e.g., protrusion 46) the diameter is the width of the moveable element 300 at the protrusion. The term radius generally refers to a distance from an axis located at the center of the moveable element to the most radially outward point (relative to the axis of the moveable element) of the object being measured, e.g., the moveable element or a part thereof (a region, a protrusion, etc.).

Figure 4:
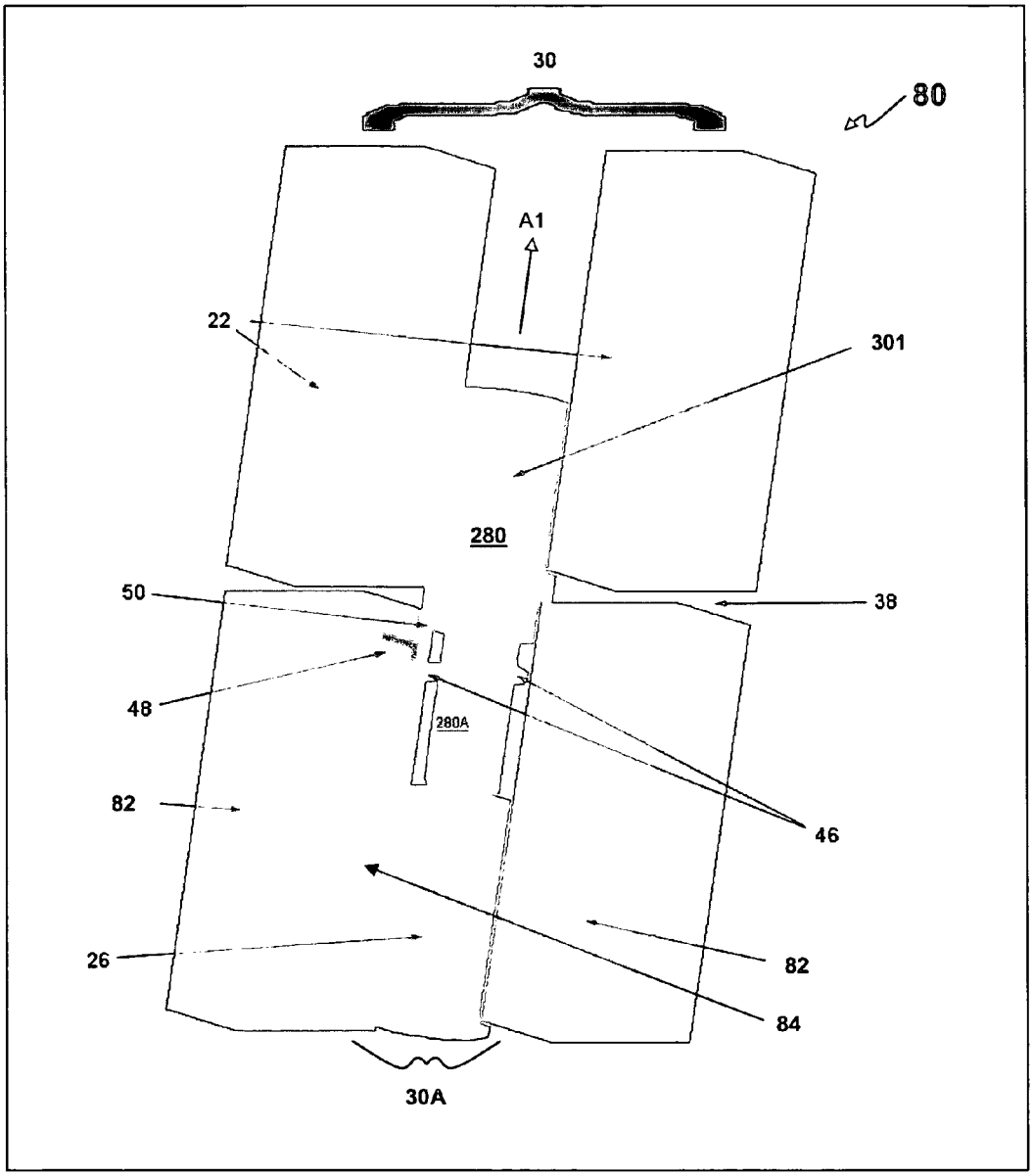
FIG. 4 is a view of an embodiment of a moveable element installed in a lock in accordance with an embodiment of the invention.

FIG. 4 shows another embodiment of a moveable element 301 located in a lock 80. A shaft 30 is provided in the housing of the lock 80. In addition, a shaft 30A is provided in the plug 82. The shaft 30 and the shaft 30A are coaxially located when the lock 80 is in the locked position. FIG. 4 also illustrates a recess 48 located in a wall 84 of the shaft 30A in the plug 82. As is described in greater detail below, the recess 48 acts to capture the protrusion 46 when an attempt is made to pick the lock 80.

Figure 5:
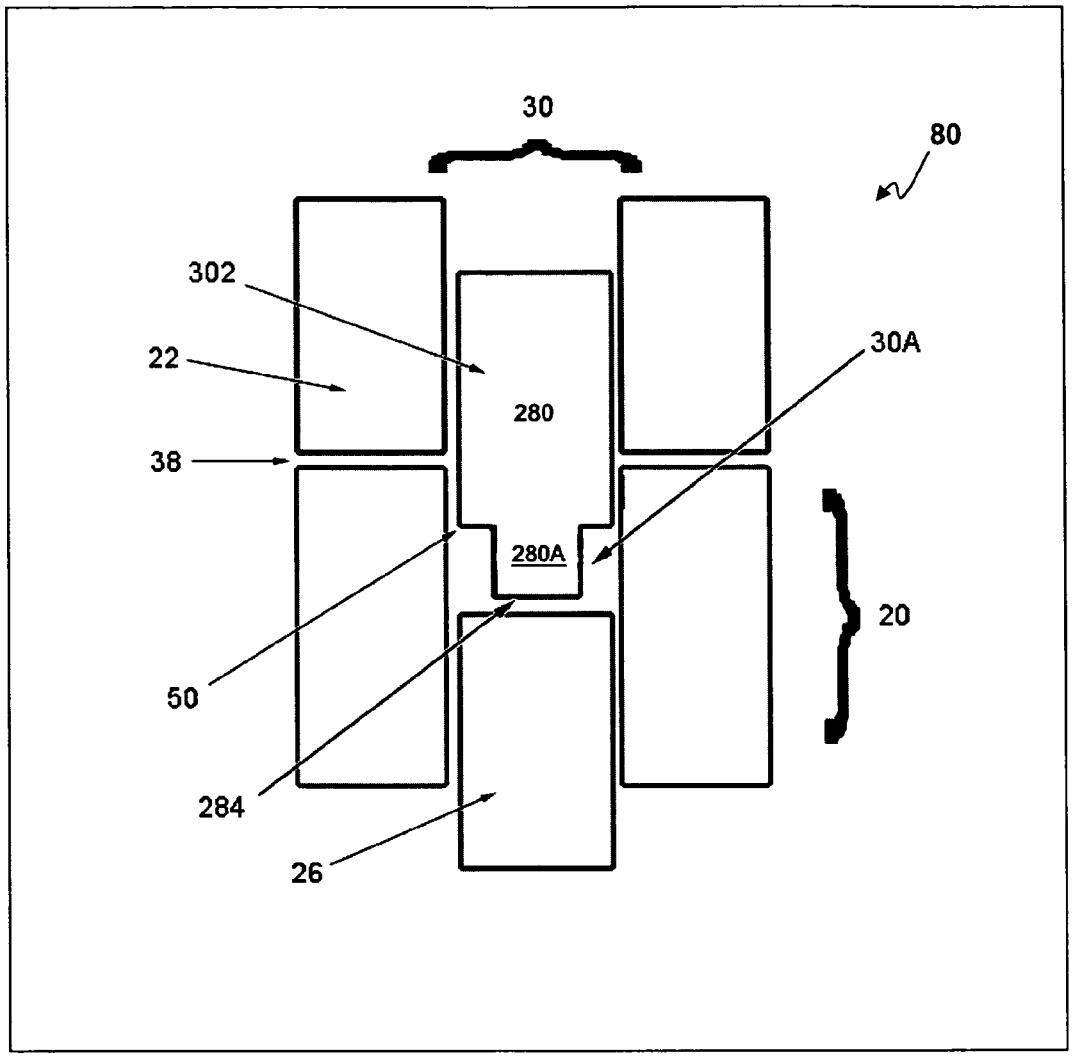
FIG. 5 is a view of another embodiment of a moveable element installed in a lock in accordance with an embodiment of the invention.

FIG. 5 illustrates a cross-sectional view of a lock 80 according to one embodiment of the invention. In FIG. 5, a moveable element 302 is disposed in shaft 30 in the housing 22 and shaft 30A in the plug 20 in a manner similar to that discussed above in connection with conventional locks. A key pin 26 also is disposed in the shaft 30A below the moveable element 302.

Figure 6:
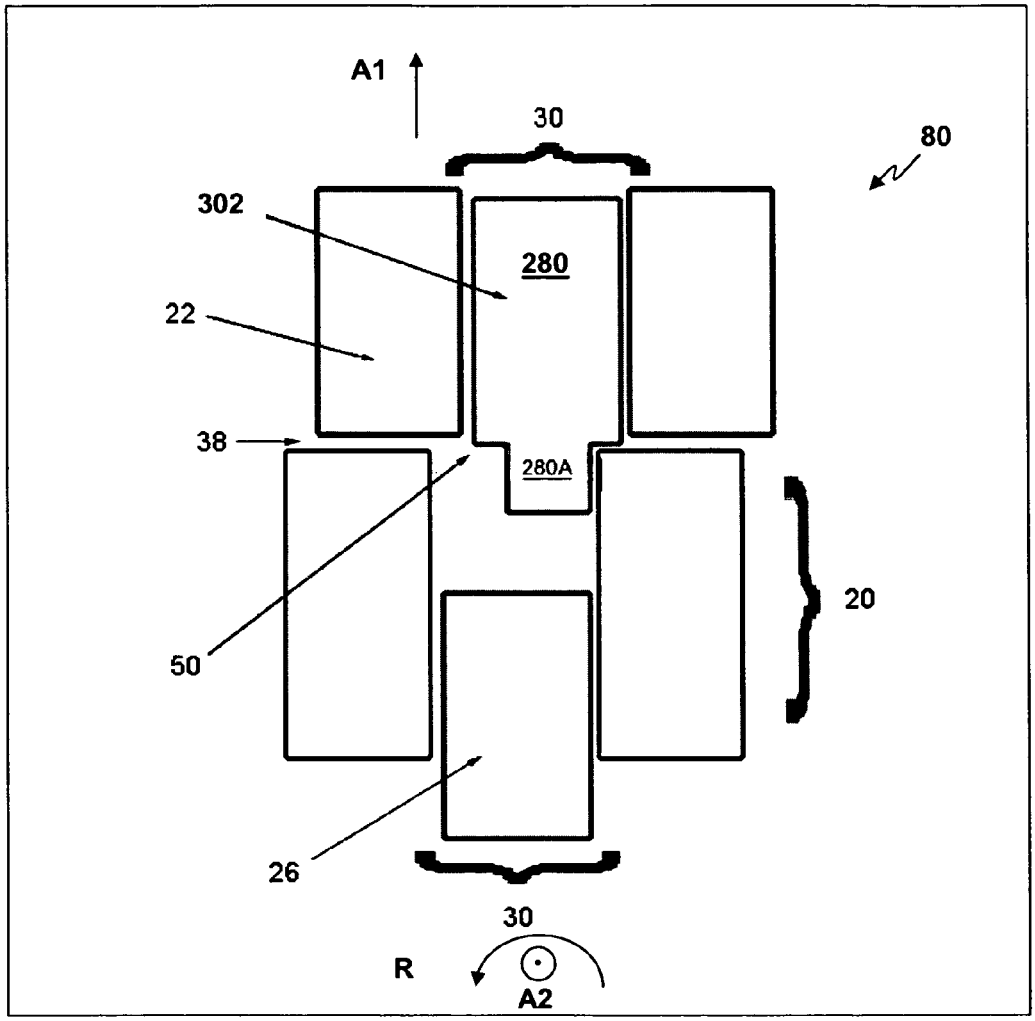
FIG. 6 is a view of the lock shown in FIG. 5 with the moveable element in a different position.

In the embodiment of FIG. 5, however, the moveable element 302 includes multiple regions (e.g., regions 280, 280A) with different diameters. Thus, a two-tiered moveable element is provided with a ledge 50 located at a point where the two regions (e.g., 280 280A) meet. Such a multi-tiered moveable element effectively requires a lock to be picked twice, once to move all the moveable elements 302 such that a first ledge 50 is located at the shear line 38, as shown in FIG. 6, then to further move each moveable element 302 in the lock 80 so that the radially inward surface 284 is positioned at the shear line 38 between the housing 22 and the plug 20. The multi-tiered moveable elements 302 cannot be picked to the shear line immediately because the manufacturing tolerances/defects that allow a conventional lock to be picked (as discussed above) are not large enough to allow a rotation of the plug sufficient to rest the radially inward surface 284 of the multi-tiered moveable element 302 onto the edge of the shear line 38 created by the slightly rotated plug 20 until all the moveable elements 302 are positioned such that the first ledge 50 is located at the shear line 38. Thus, a lock 80 employing a multi-tiered moveable element 302 including two or more regions having different diameters provides one approach for improving the pick-resistance of a locking system.

Figure 14:
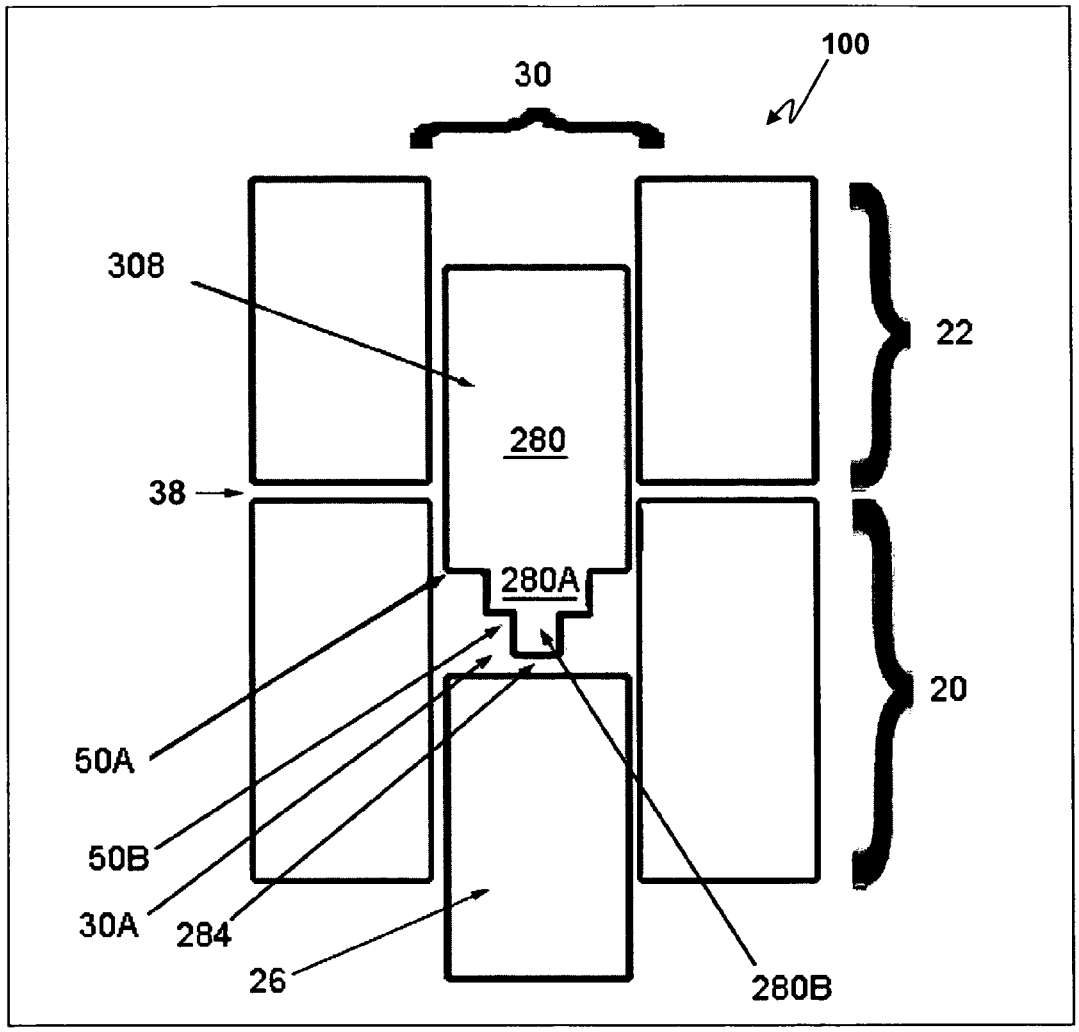
FIG. 14 is a view of an embodiment of a moveable element according to an embodiment of the invention.

Referring to FIG. 14, an embodiment of a moveable element is shown which includes three regions, for example, the first region 280 with a first diameter, the second region 280A with a second diameter, and a third region 280B with a third diameter. As a result, two ledges are formed by the moveable element 308, a first ledge 50A and a second ledge 50B. Also, the radially inward surface 284 is present on one side of the third region 280B in the embodiment shown in FIG. 14.

Examples of an axis of motion A1, an axis of rotation A2, and a direction of plug rotation R according to one embodiment of the invention are included in FIG. 6 for reference.

Figure 7:
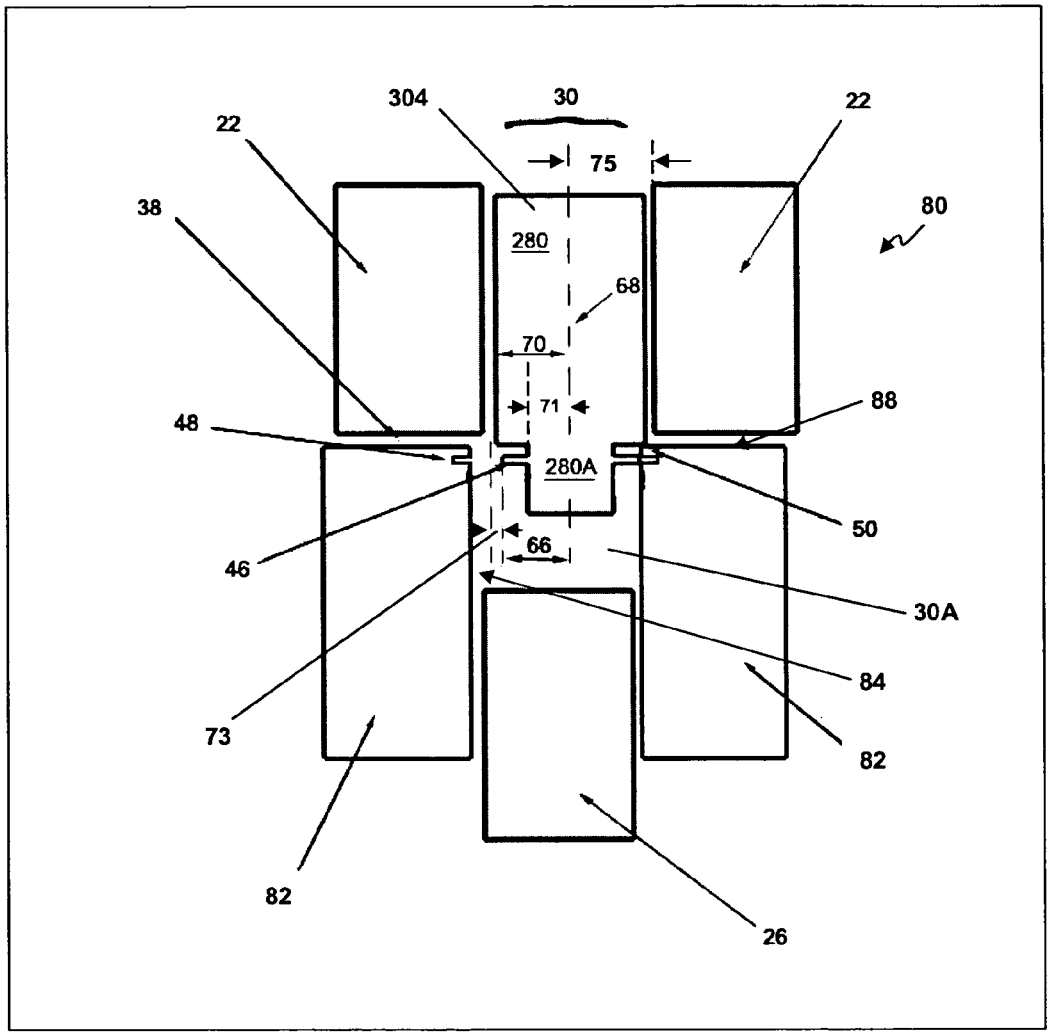
FIG. 7 is a view of yet another embodiment of a moveable element installed in a lock in accordance with an embodiment of the invention.

According to other embodiments, as illustrated in FIGS. 3, 4 and 7, one or more protrusions 46 may be included in a region 280A of a multi-tiered moveable element. According to a further embodiment, the protrusion 46 extends around the entire perimeter of the region 280A and forms a disc-like ring around the multi-tiered moveable element (e.g., moveable element 304). In another embodiment, the protrusion 46 does not extend around the entire perimeter of the region 280A, but instead may include multiple discontinuous protrusions (e.g., elements 46A, 46B) oriented transversely to a center axis 68 of the moveable element 304. In yet another embodiment, the protrusion 46 may be shaped as a bar, cylinder, or any other shape consistent with a function of the protrusion 46, for example, generally to make a lock more difficult to open without the correct key. Each protrusion may extend substantially perpendicular from an axis 68 of the moveable element. In still another embodiment, the protrusion may be placed on only one side of the pin, forming a semicircle in the case of the disk-like embodiment or a single bar in the case of the bar-shaped protrusion embodiment. In a still further embodiment, for example, as shown in FIG. 7, a radial dimension 66 of the protrusion 46 (i.e., the distance from the central axis 68 of the moveable element 304 to the most radially outward end of the protrusion 46) is less than a radial dimension 70 of the region 280 of moveable element 304. Regardless of the type of protrusion 46 that may be included with the moveable element (e.g., moveable element 304), the protrusion 46 may form a separate region with the radial dimension 66, or it may be included in a region (e.g., region 280A) where the region has a radial dimension 71 and the protrusion has radial dimension 66. In addition, the region 280A where a protrusion is located may be further defined by a first region radially outward of the protrusion 46 and a second region radially inward of the protrusion (relative to, for example, the axis of rotation). In one embodiment, a protrusion 46 is defined as an area with a diameter that is greater than the diameter of an area located radially inward of the protrusion and greater than the diameter of an area located radially outward of the protrusion. In view of the foregoing, again it should be appreciated that a number of different arrangements are possible for implementing one or more protrusions on one or more regions of a moveable element according to various embodiments of the present invention.

In the embodiments shown in FIGS. 4 and 7, a recess 48 is made in the wall 84 located in the shaft 30A. The recess 48 is capable of receiving the protrusion 46. The recess 48 may extend for any distance into the plug 82. For example, the recess 48 may go through the plug 82, and may also be made through the cylinder housing. In versions of these embodiments, the protrusion 46 is located on the moveable element (e.g., 301, 304) so that the protrusion 46 is located adjacent to and is aligned with the corresponding recess 48 when the ledge 50 is aligned with the shear line 38, as illustrated in FIG. 7.

Figure 8:
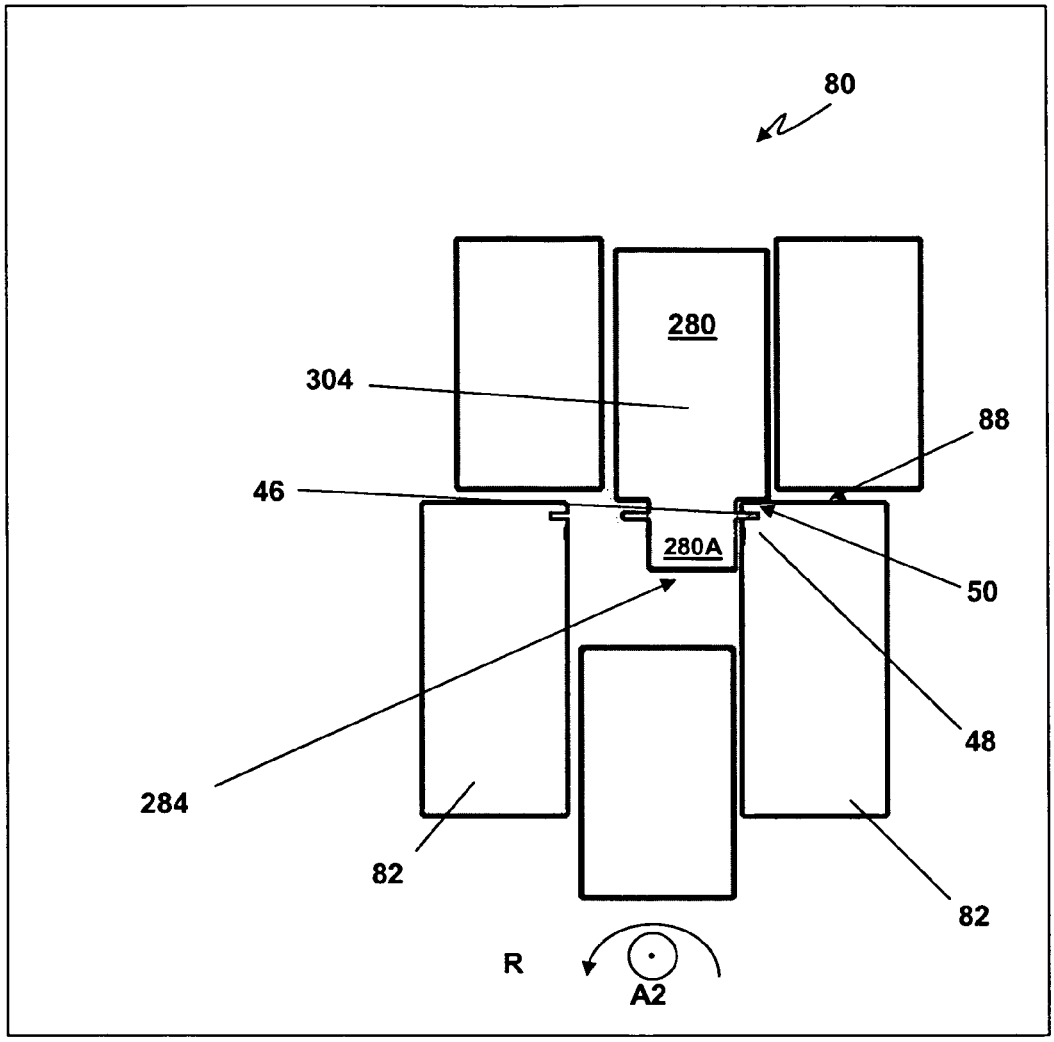
FIG. 8 is a view of the moveable element and lock according to the embodiment of FIG. 7.

As shown in FIG. 8, an attempt to rest the ledge 50 on a surface 88 of the plug 82 by further rotation of the plug 82 in the direction R (this being necessary to position a second moveable element (e.g., moveable element 301, 304) into the same configuration as illustrated in FIG. 7, or to continue picking the lock when all of the moveable elements (e.g., 301, 304) are positioned as is illustrated in FIG. 7) is likely to result in the protrusion 46 being captured within the recess 48. As a result, an individual employing a traditional lock-picking approach is faced with a moveable element 304 secured in a position which prevents the plug 82 from being rotated to an unlocked position because the moveable element 304 is unable to move along the axis A1 in the shaft (30, 30A) and is positioned between the plug 82 and the housing 22. The individual is now forced to rotate the plug 82 in a clockwise direction relative to the axis A2 (i.e., remove the applied torque). Rotating the plug 82 backwards in order to unbind the protrusions 46 from the recesses 48 in the plug 82 is likely to result in one or more moveable elements 304 falling back into the shaft 30 in a fully unpicked position, e.g., radially inward. As a result, the individual may be forced to begin the lock-picking process again. More specifically, because the plug 82 cannot rotate far enough in the direction R to reach the radially inward surface of the protrusions 46, the moveable elements 304 cannot be moved to the point where surface 284 rests on surface 88 without first resting all of the moveable elements 304 in the lock 80 to their respective ledges, e.g., ledge 50.

According to one embodiment, the protrusions 46 have a shorter radial dimension 66 (relative to the axis 68) than a radial dimension 70 of the region 280 of the moveable element 304, such that a difference between a radius of a first region 280 and a radius of a protrusion 46 (the difference being labeled 73 in FIG. 7) is greater than twice a difference between a radius 75 of the shaft 30 and the radius 70 of the first region 280. As a result, the protrusions 48 cannot rest on the surface 88 before the ledge 50 rests on the surface 88. That is, because only a limited rotation of the plug is possible (an amount determined by the smallest manufacturing tolerance/defect) while the moveable elements 304 bind the plug 82 to the housing 22, the widest section of the moveable element rests on the plug 82 at the shear line 38 first. Thus, the ledge 50 will rest on the surface 88 when the radial dimension 66 of a protrusion 46 is smaller than a radial dimension 70 of the region 280, such that a difference between a radius of a first region 280 and a radius of a protrusion 46 is greater than twice a difference between a radius 75 of the shaft 30 and the radius 70 of the first region 280. In one embodiment, the largest difference between the radius 75 of the shaft 30 and the radius 70 of the first region 280 is selected from among all the moveable elements and respective shafts combinations found in the lock. That is, the difference is determined for each moveable element relative to the shaft that it travels in. Then, the difference between the radius of the first region 280 and the radius of the protrusion 46 (i.e., dimension 73) on each moveable element is determined based on the largest difference. As mentioned above, the difference between the radial dimension 66 and the dimension of the first region 280 is identified with reference character 73.

Figure 9:
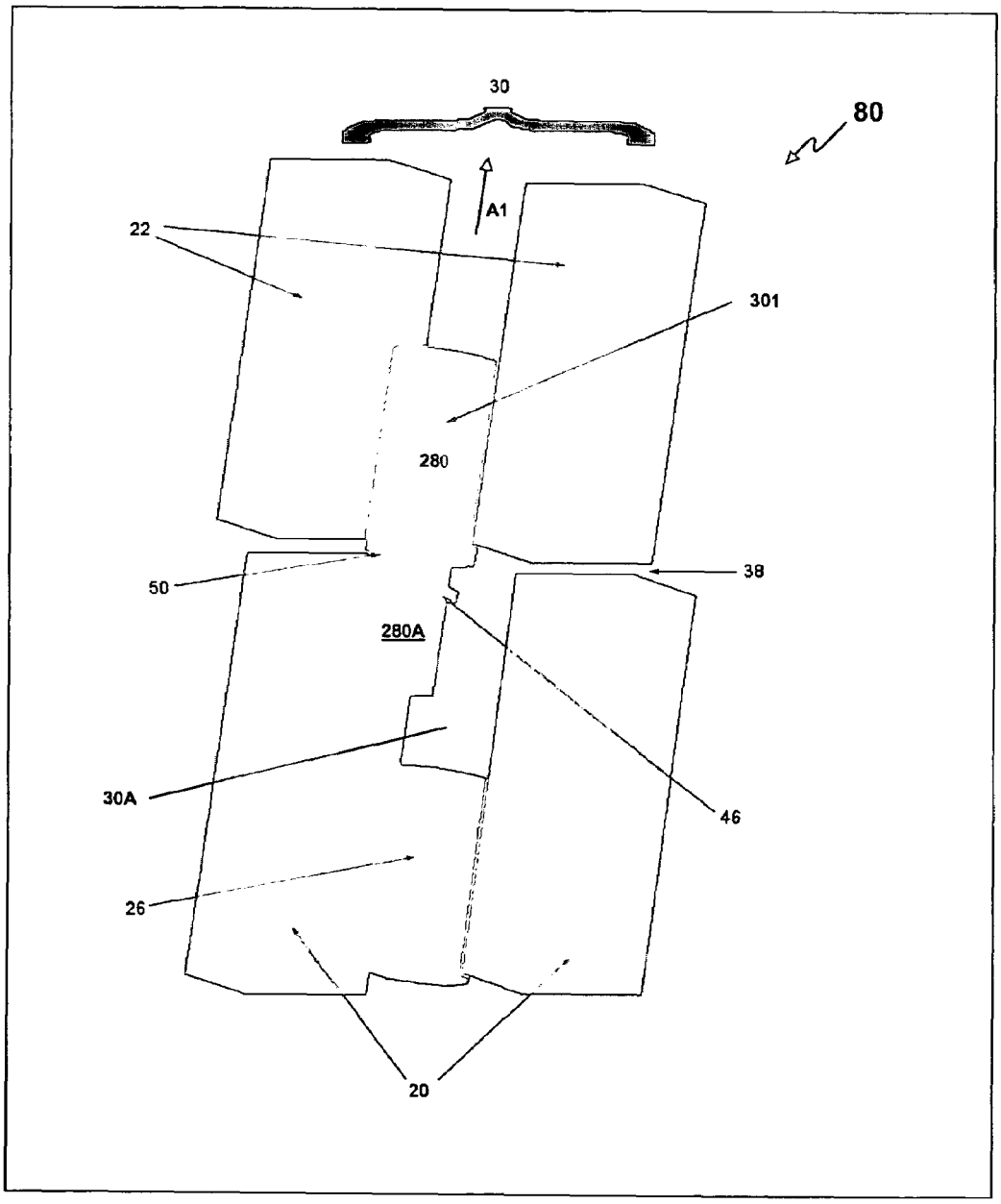
FIG. 9 is a view of the moveable element and lock according to the embodiment of FIG. 4.

FIG. 9 shows a lock 80 in accordance with the embodiment shown in FIG. 4 where a protrusion 46 is engaged in a recess (e.g., a recess 48) so that the moveable element 301 is prevented from moving further in the axis of motion A1.

Figure 10:
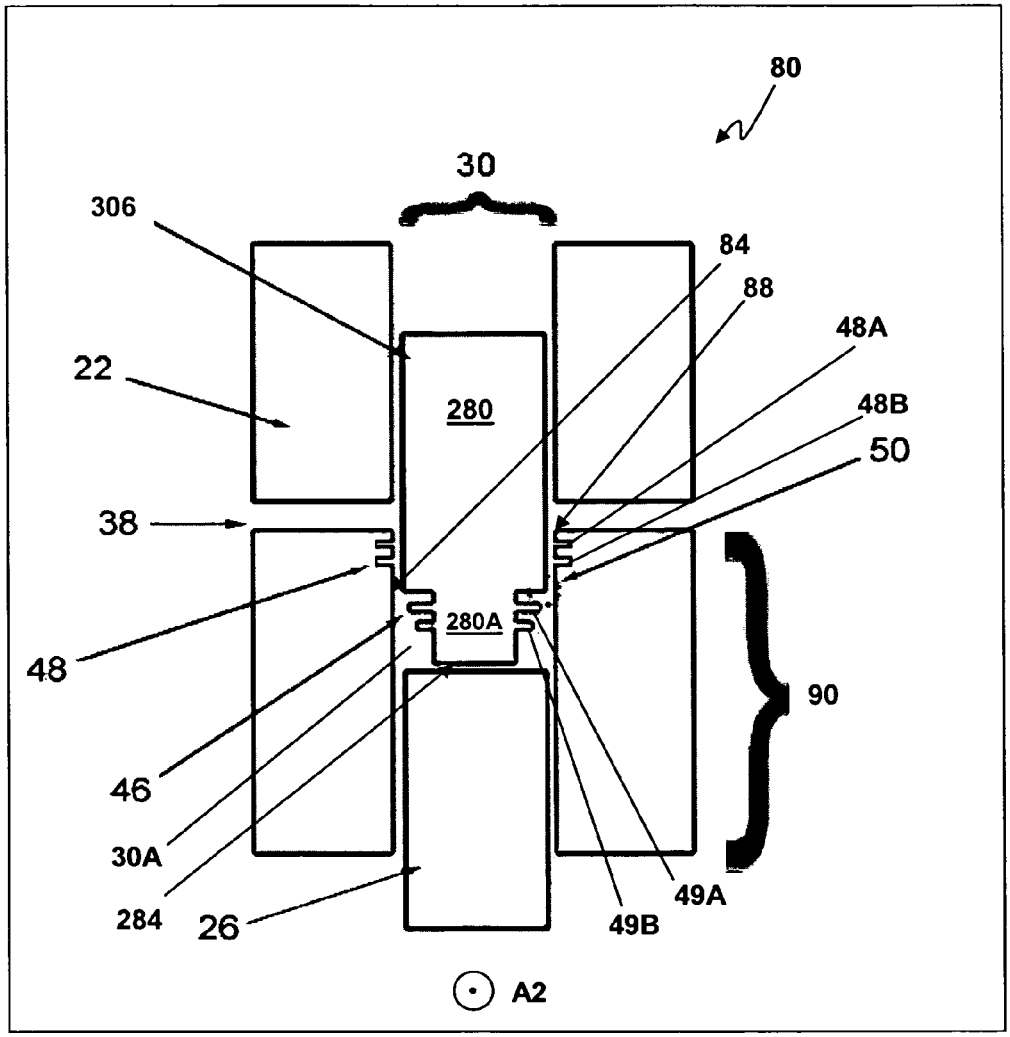
FIG. 10 is a view of a further embodiment of a moveable element and a lock according to an embodiment of the invention.

In yet another embodiment, as shown in FIG. 10, multiple protrusions 46 are present on one or more moveable elements 306. While FIG. 10 shows two such protrusions 46, it should be appreciated that the invention is not limited in this respect, as moveable elements 306 according to different embodiments may include three or more protrusions 46. Further, according to one embodiment, a lock 80 employs multiple moveable elements 306 each with one or more protrusions 46. Where each moveable element 306 includes multiple protrusions (e.g., protrusions 49A and 49B), the protrusions may be of equal length on each moveable element 306. That is, a first protrusion 49A located on a first moveable element 306 has a length equal to a first protrusion located on a second moveable element 306 in the lock 80, and a second protrusion 49B located on the first moveable element has a length equal to a second protrusion 49B located on the second moveable element. In a version of this embodiment, the first protrusion on each moveable element 306 (e.g., protrusion 49A) is located an equal distance from a reference point on the moveable element 306 (e.g., the ledge 50 or the surface 284), and a second protrusion on each moveable element 306 (e.g., protrusion 49B) is located an equal distance from the reference point.

According to one embodiment, multiple protrusions 46 located on a moveable element 306 equidistant from the ledge 50 have the same radius 66 (e.g., a maximum radius). Thus, in one embodiment, protrusion 49A is a first plurality of protrusions located further radially outward (relative to the axis of rotation A2) than protrusion 49B which in this embodiment is a second plurality of protrusions. In a version of this embodiment, the protrusions 49A include a plurality of protrusions which each have a length (e.g., a radius) that is smaller than a length of region 280 and greater than the length of the plurality of protrusions 49B. A similar approach (i.e., protrusions 46 with graduated lengths according to their respective distance from surface 284 or ledge 50) can also be employed with a series of single protrusions located at various locations along the moveable element 306. In addition, a combination of single and multiple protrusions may be employed.

As also illustrated in FIG. 10, the shaft 30A may include multiple recesses 48 (e.g., located in the plug 90) which can accept multiple protrusions (e.g., protrusions 49A and 49B). In one embodiment, two recesses 48 are located in the wall 84 of the shaft 30A so that both protrusions 49A and 49B can be captured in separate recesses 48A and 48B at the same time according to, for example, the alignment shown in FIG. 11. In a version of this embodiment, the distance between the two protrusions is the same as the distance between the protrusion 49A and the ledge 50. As a result, the recess 48A accepts the protrusion 49B when the protrusion 49A is at the shear line 38 and the plug 90 is rotated in the direction R. In addition, the recess 48A accepts the protrusion 49A when the ledge 50 is at the shear line 38.

Where multiple protrusions at different radial distances along the axis A1 from ledge 50 are located on a moveable element in a lock, an individual attempting to open the lock may be required to rest each successive protrusion (e.g., protrusions 49A and 49B) on a surface (e.g., surface 88) at the shear line 38 before the lock can be opened without the correct key. Thus, in one embodiment employing multiple moveable elements 306, the longest protrusion on each moveable element must be moved to the shear line 38 before the next longest protrusion on each moveable element is moved to the shear line 38. This process (e.g., the gradual movement of the moveable element 306 away from the axis of rotation A2) is repeated in order to rest the surface 284 of each moveable element at the shear line 38. In addition, where the length of protrusions vary from one moveable element to the next moveable element, attempts to open the lock require that each moveable element be moved in succession beginning with the moveable element with the longest protrusion, assuming a lock with no difference in defect from shaft to shaft.

If an individual attempts to circumvent the sequential approach described here (e.g., a shorter protrusion 49B is moved to the shear line 38 first), a moveable element 306 with a longer protrusion will have that protrusion move into a recess 48 when torque is applied to the plug 90. In theory, if the moveable element with the longest protrusion were picked first, then very careful rotation of the plug might allow an individual to rest the protrusion 46 on the shear line edge 38 without any of the protrusions on the other moveable elements 306 moving into a recess 48. This procedure could possibly be repeated for the moveable element 306 with the next longest protrusion, and so on until all the moveable elements are moved to the level of the protrusions (e.g., protrusions 49B).

It should be appreciated that if the manufacturing tolerances/defects in the lock 80 do not allow for movement of the moveable elements 306 in the order prescribed by the varying radial dimensions of the protrusions, the lock may prove impossible to pick. Such a result may be achieved because, as each moveable element 306 is moved to a position where it rests on the plug 90, the plug 90 rotates farther from a rest position with applied torque. These small rotations, which are associated with the inherent tolerances/defects in the lock, may be sufficient to cause the protrusions of the moveable elements 306 resting on the shear line 38 to move into corresponding recesses. When this occurs it may become impossible to open the lock without the correct key because one or more protrusions may prevent the surface 284 of a moveable element 306 from being moved to the shear line 38.

Figure 11:
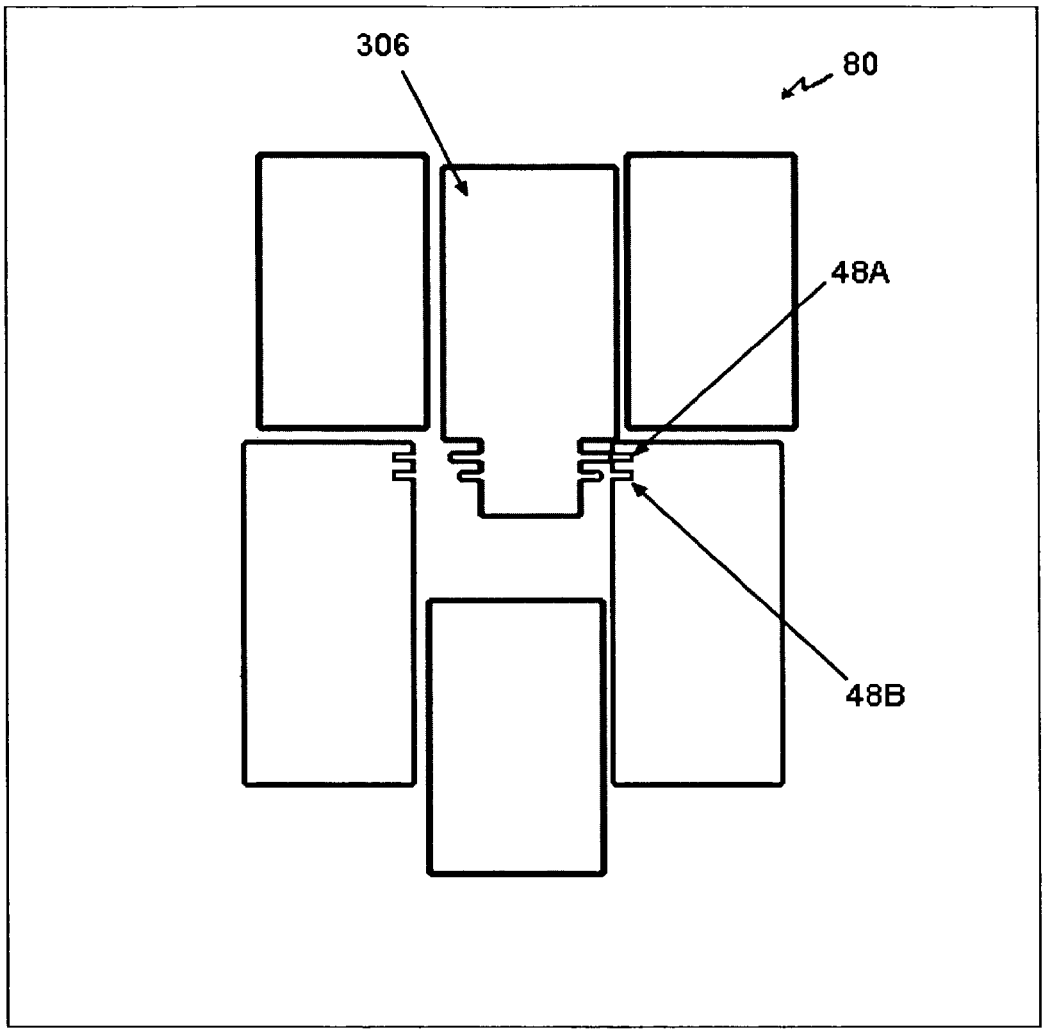
FIG. 11 is a view of the moveable element and a lock according to the embodiments of FIG. 10.

In the multi-protrusion embodiments illustrated in FIGS. 10 and 11, the lock inhibits operation without a key (i.e., lock-picking) in at least the following four ways.

First, the configuration of the region 280A prevents the plug 90 from being rotated far enough to allow the surface 284 of the moveable elements 306 to rest on the surface 88 at the shear line 38. Thus, each moveable element 306 is moved to a position where the ledge 50 aligns with the shear line 38 before the plug 90 can be rotated far enough to move the moveable element further such that a protrusion (e.g., one of protrusions 49A and 49B) can rest on the surface 88. In such an embodiment, a moveable element 306 cannot be moved directly from a first position where the ledge 50 is on the surface 88 to a second position where the surface 284 is on the surface 88 because of the interruption provided by the protrusions (as is described in further detail below).

Second, when a moveable element is moved to a position where a ledge 50 is at the shear line 38, the protrusions are adjacent to the recesses (e.g., 48A and 48B). If any rotational torque is applied to the plug 90 at this point, the protrusions 49A, 49B are captured in the recesses to prevent further movement of the moveable elements along the axis A1.

Third, if one were to successfully move each of the moveable elements 306 to a position where the ledge 50 rests on the surface 88 without allowing the upper protrusions to engage a recess (this would take a great deal of precision and would have to be done by hand), the moveable element would then have to be moved to a position where the upper protrusion 49A rests on the surface 88. Where the lower protrusions 49B vary in length from moveable element to moveable element, the moveable elements would then have to be moved in a specific order (i.e. an ordering scheme will be created), starting with the moveable element with the longest lower protrusion 49B, assuming a lock with no difference in tolerance/defect from shaft to shaft. If the proper order is not selected, the moveable elements 306 that include the longer lower protrusions 49B will have their lower protrusion engage a recess. As a result, those moveable elements will be bound to the plug 90 and prevent any further movement in the direction of axis A1 of those moveable elements.

Fourth, if the above problems are overcome and the lower protrusions of each moveable element are located at the shear line 38, the moveable elements must still be moved such that surfaces 284 rests on the surface 88.

The above described embodiments may also prevent the successful use of both raking and pick guns. In particular, the torque required to use a pick gun or a rake is likely to cause the protrusions to move into the recesses at some point during the lock-picking process, thus thwarting the attempt at picking. Even if the pick gun or rake operation allowed movement of the moveable elements, rakes and pick guns act to "set" pins (that is, accomplish the task of getting the moveable elements to rest at the shear line 38) in an order determined by the tolerances/defects in the lock, which is not necessarily the order that the moveable elements must be moved because of the length-varying protrusions. Furthermore, it should be noted that width of the key pins will prevent rotation of the lock beyond the defect during the picking process, assuming the radius of the key pin is the same or larger than the radius of the widest portion of the moveable element, i.e., the first region 280. If the radius of the key pin is greater than the widest portion of the moveable element, the tolerance/defect upon which the length of the various protrusions is determined may be based on the tolerance/defect associated with a key pin and its associated shaft. Thus, in the common arsenal of lock picking methods, this leaves only the individual picking of each moveable element individually as a viable alternative, and, as described above, even this method is presented with challenges that may prove impossible to overcome.

If all the moveable elements are locked into place by the protrusions, there may be a method by which the relative key pin heights could be measured and in order to reproduce a key using this information. However, this would only work if the ledges of the multi-tiered moveable elements were cut to the same height.

Figure 12:
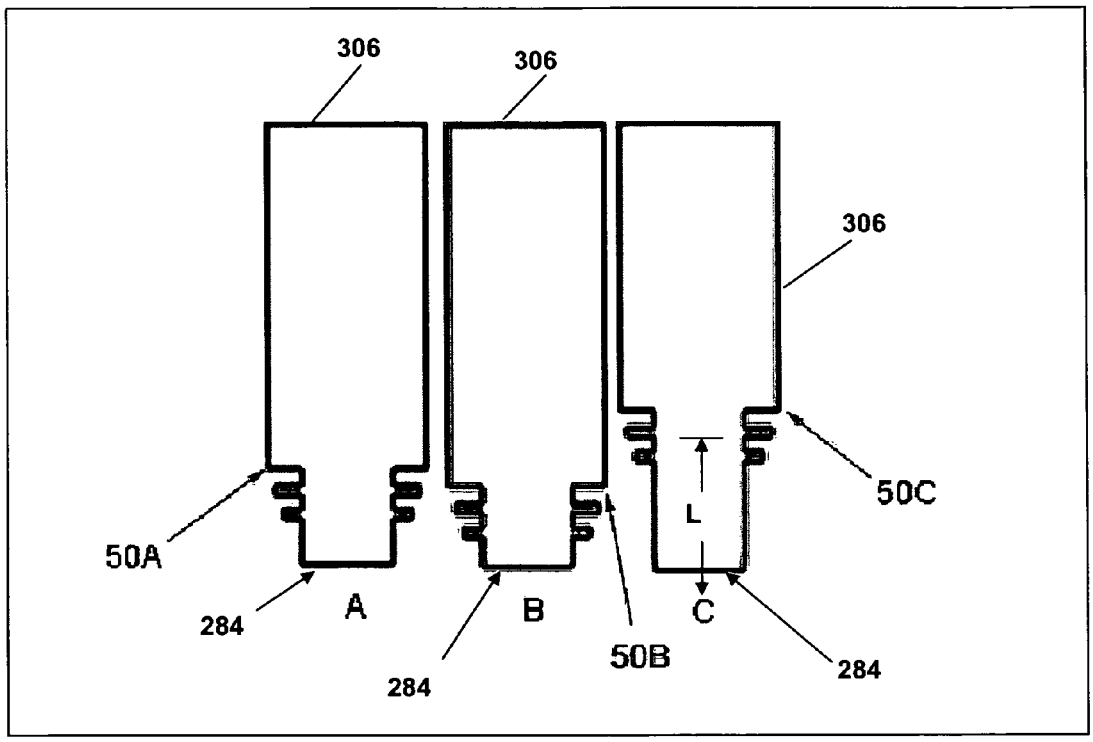
FIG. 12 is a view of multiple embodiments of moveable elements according to embodiments of the invention.

In yet other embodiments of a lock according to the invention, as illustrated in FIGS. 12A, B, and C, the ledges 50A, 50B and 50C of the multi-tiered moveable elements are cut at various heights (relative to surface 284) to prevent this method from working. In addition, according to one embodiment, the protrusions may sit at different distances from the surface of the moveable elements.

In yet another embodiment, a lock includes a plurality of multi-tiered moveable elements, where a distance L from a surface 284 to a ledge 50 of each moveable element varies, and first or second protrusions 49A, 49B are different lengths. A method of manufacture may include the manufacture of a variety of moveable elements whereby a quantity of the types of moveable elements exceeds the maximum number of moveable elements to be used in a given lock. For example, twenty types of moveable elements could be made, each type having a unique height of the ledge (as measured from the surface 284) and a unique length of the protrusion closest to the surface 284, as the basis for a seven pin lock. Seven moveable elements can be drawn arbitrarily from this pool of twenty types for any given lock to make it difficult to predict in advance any features of a particular lock according to the present invention. In general, according to one version of any of the embodiments discussed herein, one or more sets of protrusions may be designed to vary in length.

In yet another embodiment, as shown in FIG. 13 (which is a top cross-section of a moveable element 300), an alignment element (e.g., a guide) 52 also may be cut into a portion of the moveable element 300 and fitted into the shaft 30 in the housing 22 such that the moveable element cannot rotate, but instead moves only in the axis of motion A1. Such an approach may ensure that the protrusions 46 stay rotationally aligned with the recesses 48.

As previously mentioned, manufacturing tolerances and/or manufacturing defects typically provide enough freedom of movement of a plug 82 locked in a housing 22 to allow conventional locks to be picked. More specifically (referring again to FIG. 7), some excess space is available in the shaft 30 between the moveable element 304 and the walls 84 of the shaft 30 when the plug 82 is in an "at-rest" position with no torque applied to it. A plug 82 can be rotated to the extent that this excess space allows. That is, the moveable element 304 will be forced in a direction perpendicular to the axis 68 by the rotation of the plug 82 until the moveable element is "pinned" against the wall 84 of the shaft 30. At this point, traditional approaches rely on the ability to move the moveable element 304 so that the surface 88 on the plug 82 is moved to engage the surface 284 on the moveable element at the shear line 38. This can be prevented, however, with embodiments described herein by providing a moveable element where a difference between a radius of a first region 280 and a radius of a protrusion 46 is greater than twice a difference between a radius of the shaft 30 and the radius of the first region 280. Provided that the axis 68 is coaxially located with the center of the shaft 30 (i.e., the moveable element 304 is centered in the shaft), such a result is achieved, for example, in the embodiment shown in FIG. 14, when the radial distance 70 less the radial distance 66 is greater than twice as large as the radial distance 75 less the radial distance 70.

The embodiment described above results in the rotation of the plug 82 being stopped by the pinned moveable element 304 before the plug has traveled far enough to align the surface 88 with a radially inward surface of the second region. A similar relationship between the radial distance 66 and the radial distance 71 can also be employed in the manner described above. Further, where a moveable element 304 includes multiple regions of varying diameters that form multiple ledges 50 such a relationship can be employed at each region, i.e., each region can include a protrusion where the difference between the radius of a first region with a protrusion and the radius of a protrusion on a second region is greater than twice a difference between the radius of the shaft and the radius of the first region.

In a further embodiment where a lock with multiple moveable elements with multiple protrusions protruding from the same region is employed, the difference between a first protrusion and a second protrusion protruding from the region is larger than the largest difference between two differences between a radius of a shaft 30 and the maximum radius of the corresponding moveable element (where the relationship between the diameter of shaft 30 and the maximum radius of the corresponding moveable element is determined for each moveable element/shaft combination in the lock).

Figure 15:
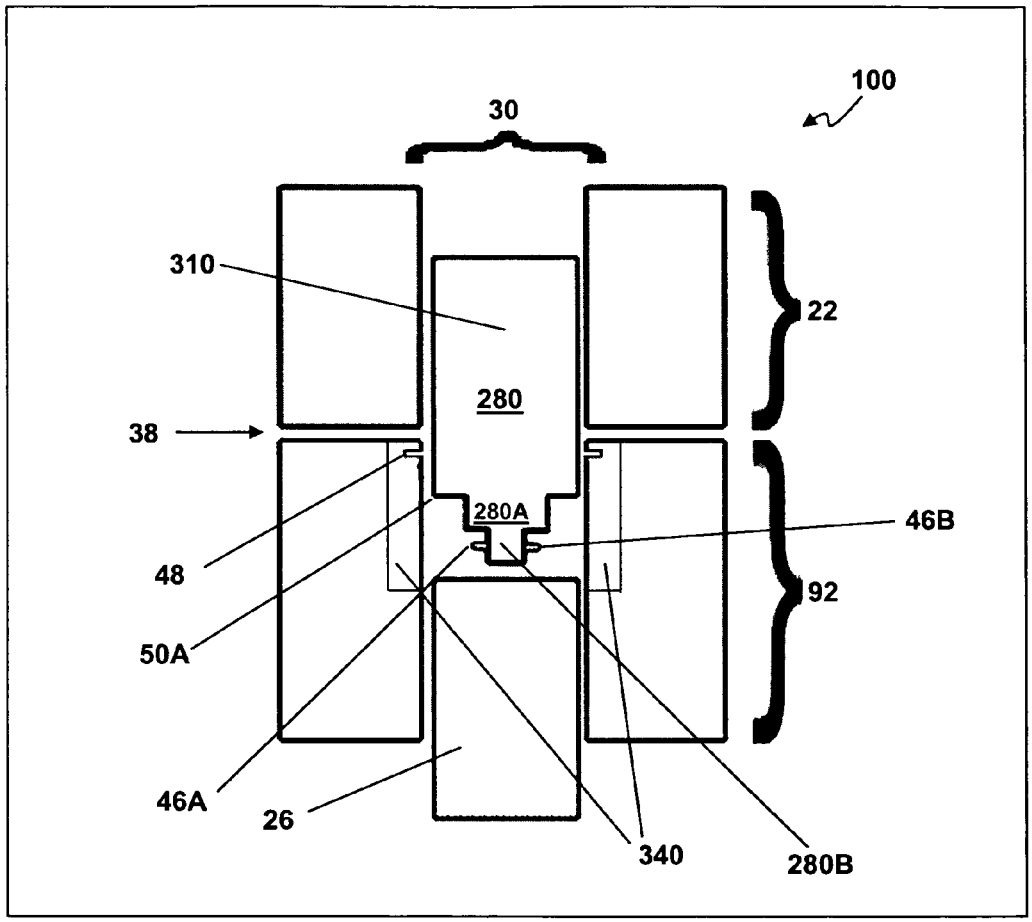
FIG. 15 is a view of another embodiment of a moveable element according to an embodiment of the invention.
Figure 16:
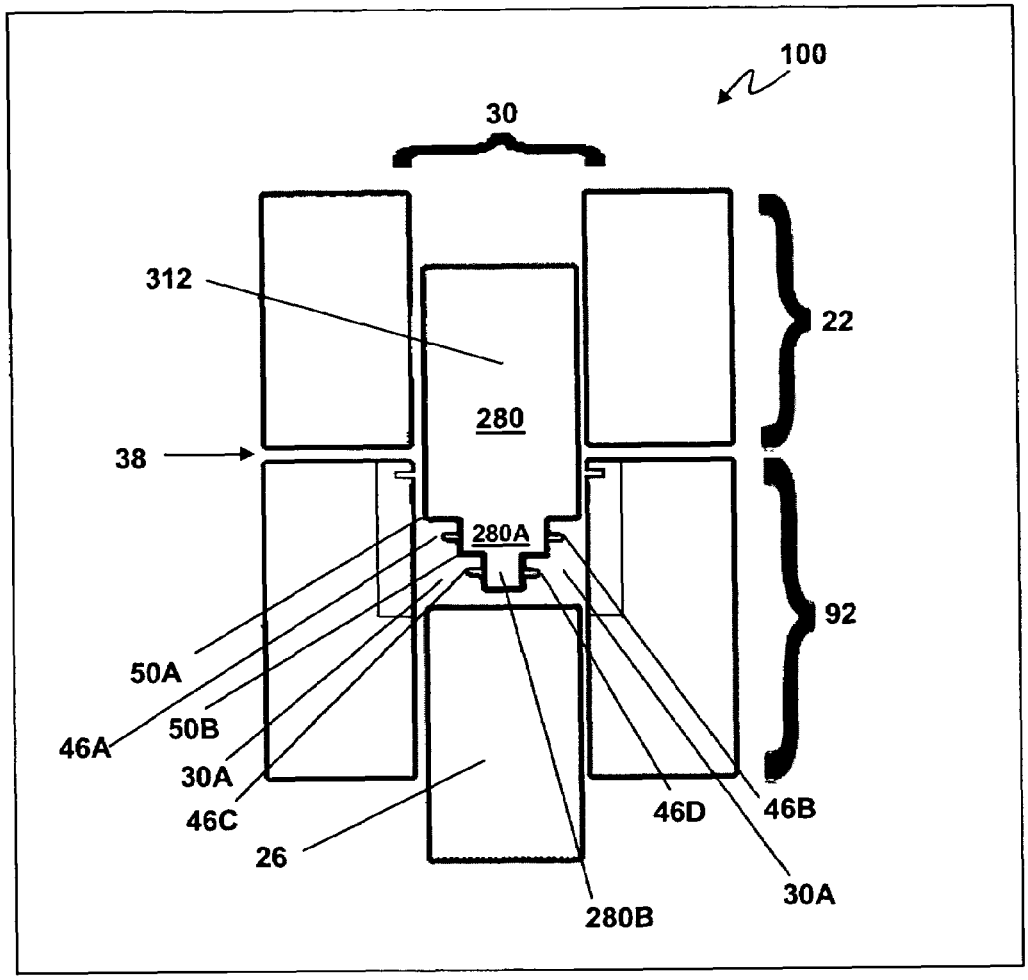
FIG. 16 is a view of yet another embodiment of a moveable element according to an embodiment of the invention.

Referring to FIG. 15, an insert 340 may be employed to adapt the plug 92 to include one or more recesses 48. An inside diameter of the insert 340 forms the shaft 30A that the moveable element 310 is located in when at least part of the moveable element 310 is located in the plug 92 as shown in FIG. 15. Accordingly, the plug 92 is adapted to include openings to receive the inserts 340.

A lock 100 employing the insert 340 may be manufactured efficiently because any recesses 48 need not be manufactured directly in the plug 92. Instead, in one embodiment, an insert 340 is manufactured with one or more recesses 48 and inserted in the plug 92. The moveable element is located in either the shaft 30 or the shaft 30A and the plug is located in the housing. The shafts 30, 30A are coaxially located when the lock 100 is in an at rest position; therefore, in one embodiment, the moveable element 310 is located in the housing 22 and plug 92, after the plug 92 is installed in the housing 22 and the shafts 30, 30A are aligned. The insert 340 need not be cylindrical in shape but may be any shape through which a moveable element can travel where the insert 340 includes one or more recesses 48 that can engage a protrusion protruding from the moveable element. Additionally, an insert 340 can be employed in any of the embodiments described herein.

Figure 17:
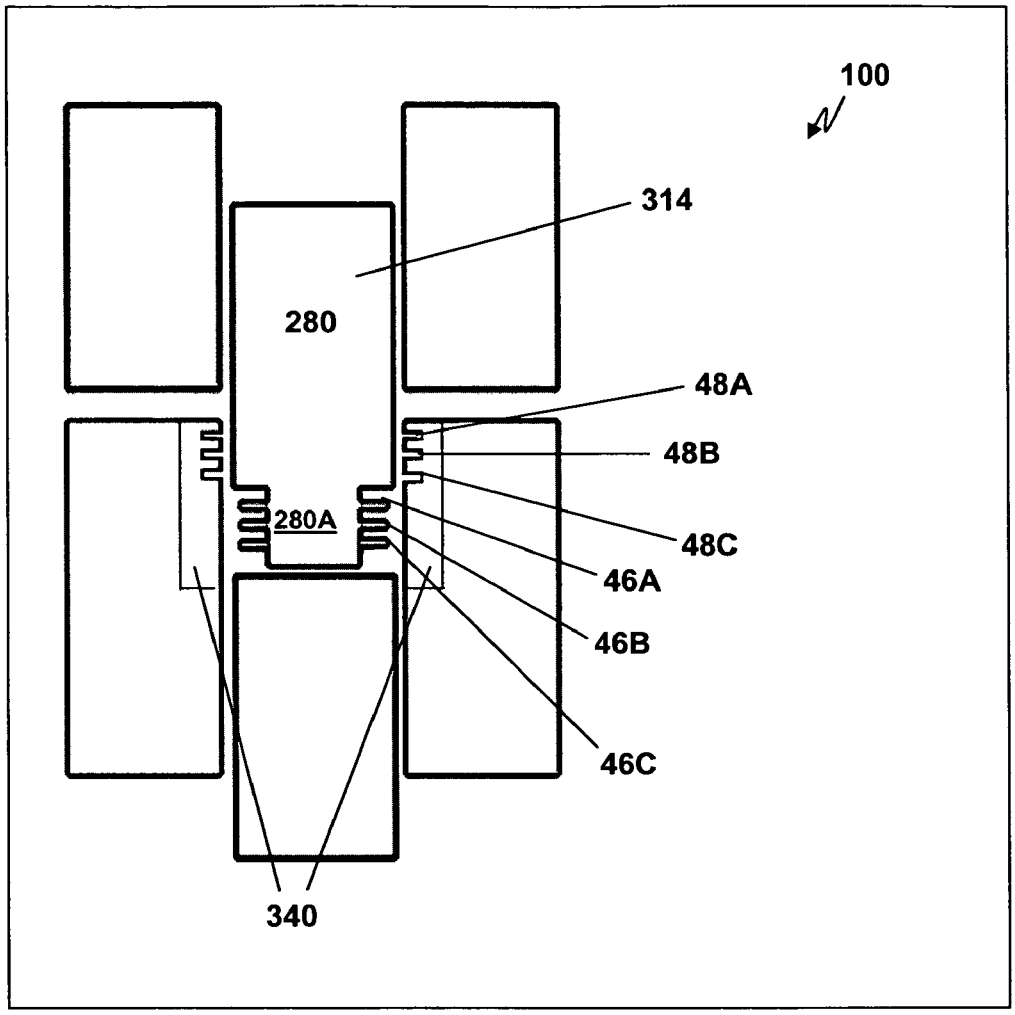
FIG. 17 is a view of a further embodiment of a moveable element according to an embodiment of the invention.
Figure 18:
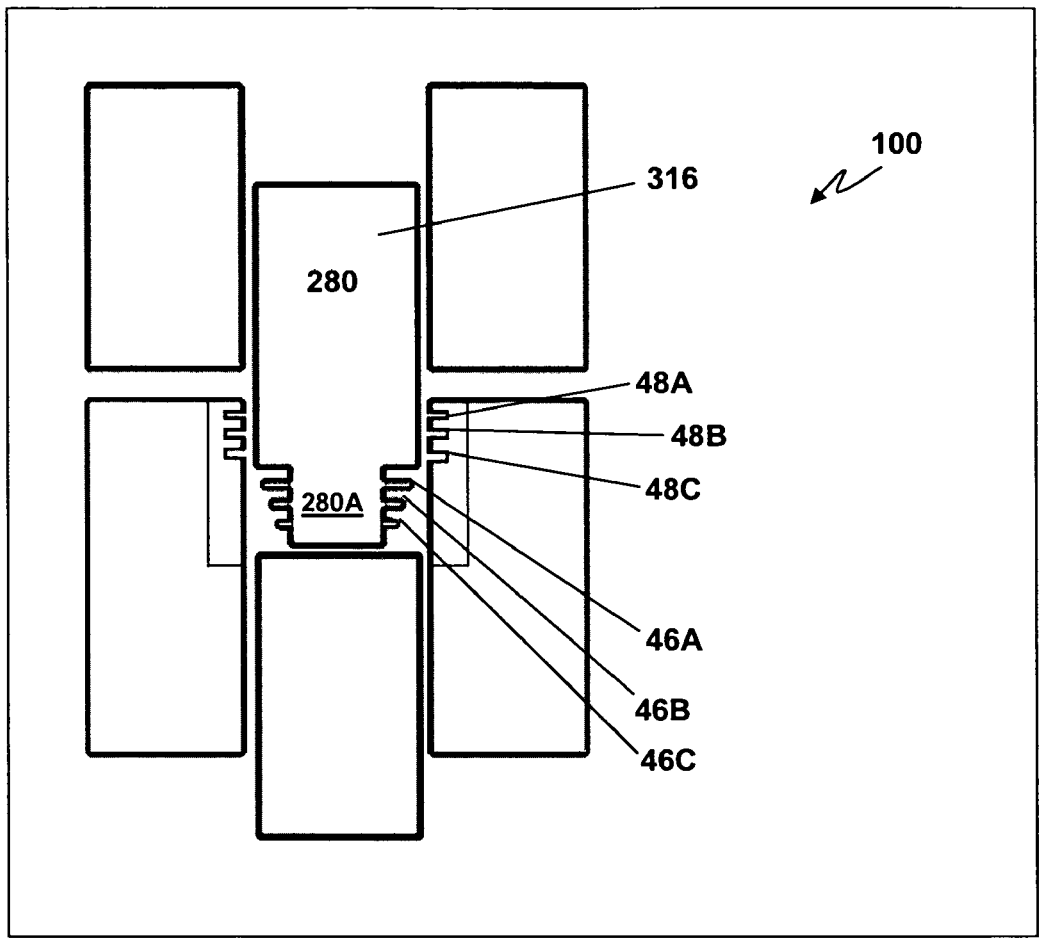
FIG. 18 is a view of another embodiment of a moveable element according to an embodiment of the invention.
Figure 19:
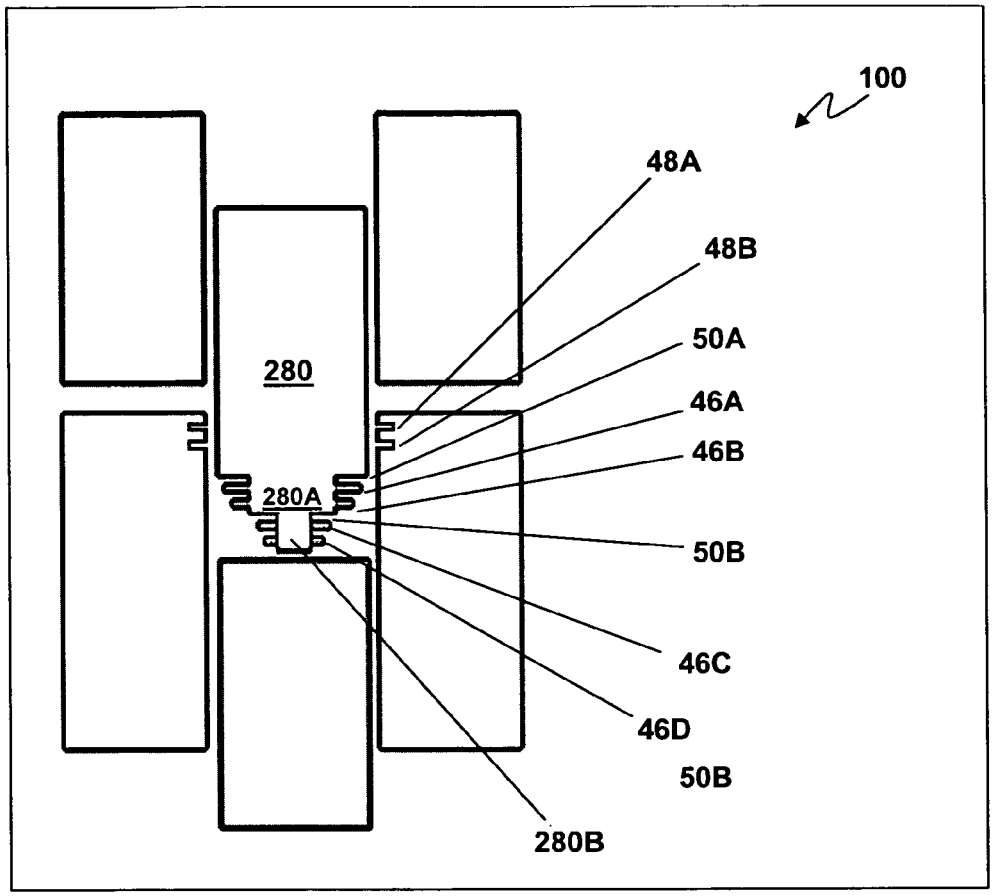
FIG. 19 is a view of yet another embodiment of a moveable element according to an embodiment of the invention.

The approaches described thus far can be employed in yet further embodiments as illustrated in FIGS. 15-18. For example, where three or more regions (e.g., regions 280, 280A, 280B) are employed, one or more protrusions (e.g., protrusions 46A, 46B) can protrude from one of the regions (e.g., region 280B in FIG. 15) or from a plurality of regions (e.g., regions 280A and 280B in FIG. 16). Further, as shown in FIGS. 17 and 18, a plurality of protrusions (e.g., protrusions 46A, 46B, 46C) may extend from one or more regions of a moveable element (e.g., moveable elements 314, 316). The protrusions 46A, 46B and 46C may each be the same diameter as in FIG. 17 or the protrusions 46A, 46B and 46C may be of different diameters as in FIG. 18.

It should be clear from the foregoing description that moveable elements are designed to prevent rotation of the plug in the lock. In one more embodiment, however, a small amount of freedom of movement (including freedom of rotational movement) remains as a result of manufacturing tolerances/defects.

It should be appreciated that all combinations of the foregoing concepts are contemplated as being part of the inventive subject matter disclosed herein. Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A lock comprising:

a housing;

a plug located in the housing, the plug adapted to rotate in the housing about an axis;

an insert adapted to provide a shaft located in the plug; and a moveable element comprising a first region with a first diameter, a second region with a second diameter that is less than the first diameter, the moveable element located at least partly in the housing, the moveable element adapted to move in the insert in an axis of motion substantially radial relative to the axis of the plug and to prevent rotation of the plug when the moveable element is in a first position along the axis of motion and allow rotation of the plug when the moveable element is in a second position along the axis of motion, wherein the second region is located closer to the axis of the plug than the first region, wherein a protrusion, with a third diameter that is greater than the second diameter and less than the first diameter, protrudes from the second region, and wherein a difference between one half of the first diameter and one half of the third diameter is greater than twice a difference between one half the diameter of the shaft and one half of the first diameter.

2. The lock of claim 1, wherein the protrusion protrudes from the moveable element less than 360° annularly about the axis of motion.

3. The lock of claim 2, wherein the protrusion is a bar.

4. The lock of claim 1, wherein the moveable element includes a third region with a fourth diameter that includes a protrusion, wherein a diameter of the protrusion in the third region is less than the diameter of the protrusion included in the second region, and wherein the third region is located closer to the axis of the plug than the second region.

5. A lock comprising:

a housing;

a plug located in the housing, the plug adapted to rotate in the housing about an axis; and a moveable element comprising a first region with a first diameter, a second region with a second diameter that is less than the first diameter, and a third region with a third diameter that is less than the second diameter, the moveable element located at least partly in the housing, the moveable element adapted to move in an axis of motion substantially radial relative to the axis of the plug and to prevent rotation of the plug when the moveable element is in a first position along the axis of motion and to allow rotation of the plug when the moveable element is in a second position along the axis of motion, wherein the second region is located closer to the axis of the plug than the first region, and wherein at least a part of the third region is located closer to the axis of the plug than the second region, and wherein the moveable element travels in a shaft located in the housing, wherein a difference between a radius of the first region and a radius of the second region is greater than twice a difference that is largest in the lock between a radius of a shaft and a radius of a first region, within a single shaft, and wherein the moveable element travels in a shaft located in the plug, wherein the shaft in the housing and shaft in the plug are located coaxially when the plug is in a locked position, wherein a portion of the shaft included in the plug is formed by an internal diameter of an insert inserted in the plug, and wherein the insert includes at least one recess adapted to receive a protrusion included in the second region of the moveable element.

6. The lock of claim 5, wherein the moveable element includes a plurality of protrusions and the insert includes a plurality of recesses adapted to receive one or more of the plurality of protrusions.

7. A lock comprising:

a housing;

a plug located in the housing, the plug adapted to rotate in the housing about an axis; and a moveable element comprising a first region with a first diameter, a second region with a second diameter that is less than the first diameter, and a third region with a third diameter that is less than the second diameter, the moveable element located at least partly in the housing, the moveable element adapted to move in an axis of motion substantially radial relative to the axis of the plug and to prevent rotation of the plug when the moveable element is in a first position along the axis of motion and to allow rotation of the plug when the moveable element is in a second position along the axis of motion, wherein the second region is located closer to the axis of the plug than the first region, and wherein at least a part of the third region is located closer to the axis of the plug than the second region, wherein the moveable element travels in a shaft located in the housing, wherein a difference between a radius of the first region and a radius of the second region is greater than twice a difference that is largest in the lock between a radius of a shaft and a radius of a first region, within a single shaft, and further comprising a plurality of moveable elements with at least one of the plurality including a first protrusion with a first radius and a second protrusion with a second radius each extending from a single region, wherein the difference between the first radius and the second radius is determined for each moveable element in the lock, and wherein a difference between the first radius and the second radius is larger than a difference that is largest between the difference between the radius of the shaft and the radius of the first region of two moveable elements in the lock.

* * * * *